US009376881B2

(12) United States Patent
Gette et al.

(10) Patent No.: US 9,376,881 B2
(45) Date of Patent: Jun. 28, 2016

(54) HIGH-CAPACITY SINGLE-TRIP LOCKDOWN BUSHING AND A METHOD TO OPERATE THE SAME

(75) Inventors: Nicholas Peter Gette, Houston, TX (US); Carl F. Boehm, Houston, TX (US); Daniel Ralph Barnhart, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 940 days.

(21) Appl. No.: 13/428,980

(22) Filed: Mar. 23, 2012

(65) Prior Publication Data

US 2013/0248196 A1 Sep. 26, 2013

(51) Int. Cl.
*E21B 33/03* (2006.01)
*E21B 33/04* (2006.01)

(52) U.S. Cl.
CPC ..... *E21B 33/03* (2013.01); *E21B 33/0422* (2013.01)

(58) Field of Classification Search
CPC ..... E21B 33/04; E21B 33/129; E21B 23/02; E21B 33/03; E21B 17/1078
USPC ..... 166/338, 348, 351, 360, 368, 378, 379, 166/382, 85.1
See application file for complete search history.

(56) References Cited

U.S. PATENT DOCUMENTS 3,086,590 A * 4/1963 Jackson, Jr. ..... E21B 33/035 166/348
3,299,954 A * 1/1967 Williams ..... E21B 29/12 166/298
3,382,921 A * 5/1968 Todd ..... E21B 33/035 166/348
3,404,736 A * 10/1968 Nelson ..... E21B 33/043 166/208
3,457,992 A * 7/1969 Brown ..... E21B 33/043 166/335
3,543,847 A * 12/1970 Haeber ..... E21B 33/043 166/115
3,561,527 A * 2/1971 Nelson ..... E21B 33/043 285/123.2
3,693,714 A * 9/1972 Baugh ..... E21B 33/047 166/348
4,089,377 A * 5/1978 Chateau ..... E21B 33/038 166/382
4,139,058 A * 2/1979 Gano ..... E21B 23/06 166/243
4,167,970 A * 9/1979 Cowan ..... E21B 43/10 166/208
4,252,187 A * 2/1981 Wilson ..... E21B 33/047 166/115

(Continued)

FOREIGN PATENT DOCUMENTS

GB 2351104 A 12/2000
GB 2489327 A 9/2012
GB 2497409 A 6/2013

OTHER PUBLICATIONS

U.S. Appl. No. 13/086,038, filed Apr. 13, 2011; First Named Inventor Thomas McCreath Wilson.

(Continued)

*Primary Examiner* — Matthew R Buck
*Assistant Examiner* — Edwin Toledo-Duran
(74) *Attorney, Agent, or Firm* — Bracewell LLP

(57) ABSTRACT

A high capacity single trip lockdown bushing and a method to operate the same is disclosed. The lockdown bushing includes a tubular body that carries a locking ring and an energizing ring about an upper portion of the tubular body. The energizing ring includes a cam portion interposed between the locking ring and the tubular body so that the cam portion and the locking ring overlap along mating cam surfaces in an unset position. A running tool carries the lockdown bushing to land on a casing hanger. The running tool is actuated to drive the energizing ring downward so that the mating cam surfaces interact to move the locking ring radially outward into engagement with wickers formed in a wellhead.

20 Claims, 8 Drawing Sheets

(56) References Cited

U.S. PATENT DOCUMENTS 4,262,748 A * 4/1981 Kirkland ..... E21B 33/047 166/313
4,298,064 A * 11/1981 Lawson ..... E21B 33/047 166/97.5
4,298,067 A * 11/1981 Lawson ..... E21B 33/047 166/341
4,333,531 A * 6/1982 Lawson ..... E21B 33/047 166/341
4,353,420 A * 10/1982 Miller ..... E21B 23/06 166/113
4,416,472 A * 11/1983 Fowler ..... E21B 33/043 166/217
4,460,042 A * 7/1984 Galle, Jr. ..... E21B 33/04 166/208
4,469,172 A * 9/1984 Clark ..... E21B 33/04 166/115
4,528,738 A * 7/1985 Galle, Jr. ..... E21B 33/04 285/123.3
4,540,053 A * 9/1985 Baugh ..... E21B 33/043 166/348
4,550,782 A * 11/1985 Lawson ..... E21B 33/043 166/382
4,595,063 A * 6/1986 Jennings ..... E21B 33/043 166/217
4,615,544 A * 10/1986 Baugh ..... E21B 33/043 166/348
4,634,152 A * 1/1987 Pettit ..... E21B 33/043 166/382
4,674,576 A * 6/1987 Goris ..... E21B 33/043 166/125
4,773,477 A * 9/1988 Putch ..... E21B 43/10 166/206
4,836,579 A * 6/1989 Wester ..... E21B 33/04 166/86.1
4,911,244 A * 3/1990 Hynes ..... E21B 33/043 166/123
4,949,786 A * 8/1990 Eckert ..... E21B 33/04 166/208
5,020,593 A * 6/1991 Milberger ..... E21B 33/043 166/208
5,025,864 A * 6/1991 Nobileau ..... E21B 33/043 166/208
5,067,734 A * 11/1991 Boehm, Jr. ..... E21B 33/04 166/84.1
5,094,297 A * 3/1992 Bridges ..... E21B 33/04 166/208
5,110,144 A * 5/1992 Burton ..... E21B 33/04 166/115
5,127,478 A * 7/1992 Miller ..... E21B 33/043 166/208
5,129,660 A * 7/1992 Taylor ..... E21B 33/03 166/196
5,174,376 A * 12/1992 Singeetham ..... E21B 33/043 166/182
5,209,521 A * 5/1993 Osborne ..... E21B 33/04 285/123.3
5,240,076 A * 8/1993 Cromar ..... E21B 23/01 166/208
5,255,746 A * 10/1993 Bridges ..... E21B 33/043 166/348
5,307,879 A * 5/1994 Kent ..... E21B 33/04 166/115
5,450,905 A * 9/1995 Brammer ..... E21B 33/043 166/123
5,544,707 A * 8/1996 Hopper ..... E21B 33/03 166/368
5,620,052 A * 4/1997 Turner ..... E21B 33/043 166/208
6,003,602 A * 12/1999 Wilkins ..... E21B 33/035 166/339
6,234,252 B1 * 5/2001 Pallini, Jr. ..... E21B 33/038 166/345
6,520,263 B2 * 2/2003 June ..... E21B 33/043 166/348
6,536,527 B2 * 3/2003 Munk ..... E21B 43/0107 166/341
6,540,024 B2 * 4/2003 Pallini ..... E21B 33/038 166/347
6,715,554 B1 * 4/2004 Cunningham ..... E21B 33/035 166/348
7,040,412 B2 * 5/2006 DeBerry ..... E21B 33/043 166/368
7,380,607 B2 * 6/2008 Thomas ..... E21B 33/038 166/208
7,500,524 B2 * 3/2009 Hopper ..... E21B 33/03 166/348
7,604,058 B2 * 10/2009 McGuire ..... E21B 33/068 166/379
7,861,789 B2 * 1/2011 Nelson ..... E21B 33/043 166/196
7,900,706 B2 * 3/2011 Ford ..... E21B 33/043 166/208
7,909,107 B2 3/2011 Gette
8,127,857 B2 * 3/2012 Sinnott ..... E21B 33/04 166/382
8,136,604 B2 * 3/2012 Jennings ..... E21B 33/038 166/177.5
8,235,122 B2 * 8/2012 Gette ..... E21B 17/1007 166/242.6
8,256,506 B2 * 9/2012 Dyson ..... E21B 33/043 166/382
8,613,324 B2 * 12/2013 Nguyen ..... E21B 33/04 166/208
2002/0040782 A1 * 4/2002 Rytlewski ..... B63G 8/001 166/341
2002/0070030 A1 * 6/2002 Smith ..... E21B 33/0407 166/379
2002/0170721 A1 * 11/2002 June ..... E21B 33/043 166/379
2005/0139360 A1 * 6/2005 Van Bilderbeek .. E21B 33/0422 166/382
2010/0276156 A1 * 11/2010 Jennings ..... E21B 33/04 166/379
2010/0326664 A1 12/2010 Neto et al.
2011/0083854 A1 * 4/2011 Jennings ..... E21B 33/035 166/348
2011/0108275 A1 5/2011 Borak et al.
2011/0168409 A1 7/2011 Gette
2011/0316236 A1 12/2011 Gette
2012/0024540 A1 * 2/2012 Harsono ..... E21B 33/04 166/382
2012/0037382 A1 2/2012 Eppinghaus et al.
2013/0043046 A1 * 2/2013 Jennings ..... E21B 33/04 166/379

OTHER PUBLICATIONS

Search Report from corresponding GB Patent Application No. GB1304956.4, dated Jul. 18, 2013.

* cited by examiner

HIGH-CAPACITY SINGLE-TRIP LOCKDOWN BUSHING AND A METHOD TO OPERATE THE SAME

BACKGROUND OF THE INVENTION

1. Field of the Invention

This invention relates in general to well tubulars and hangers and, in particular, to a lockdown bushing for increased tubular lockdown capacity and a method to operate the same.

2. Brief Description of Related Art

Typically, a lockdown bushing may be run downhole to land and set above a casing hanger to provide additional casing lockdown capability. The lockdown bushing may be needed due to thermal expansion of the casing string. Lockdown bushings improve long-term seat reliability below the lockdown bushing by sharing the cyclic axial loads applied to the casing hanger. To properly land and set a lockdown bushing, the lockdown bushing is typically run proximate to lock-ring grooves formed in the subsea wellhead axially above the casing hanger. Generally, the operation requires running of a lead impression tool prior to running and setting of the lockdown bushing. The lead impression tool determines the elevation of the lock-ring grooves for proper landing of the lockdown bushing. However, this step is often bypassed due to the costs associated with performing an additional tool trip with the drilling rig. Typically, the lockdown bushing is run, landed, and set without checking the locking ring groove elevation.

If there is a problem with the lockdown bushing, the lockdown bushing may then be removed and the elevation of the locking ring grooves checked with the lead impression tool. This adds additional downhole trips and can significantly increase the costs associated with completion of a well. Where the lead impression tool is used, the well casing will have a reduced capacity for handling upward axial loads until the lockdown bushing is installed. This can make the well more vulnerable to blowouts for a longer period of time. Still further, many lockdown bushings do not have a sufficient capacity to resist upward axial forces applied to the casing hangers in some deeper well installations. Therefore, there is a need for a single-trip lockdown bushing that may be run without a lead impression tool that also has a greater load capacity than those known in the art.

SUMMARY OF THE INVENTION

These and other problems are generally solved or circumvented, and technical advantages are generally achieved, by preferred embodiments of the present invention that provide a single trip high-capacity lockdown bushing and a method to operate the same.

In accordance with an embodiment of the present invention, a wellhead assembly, is disclosed. The wellhead assembly includes a wellhead having a bore containing a grooved profile, one or more casing hangers landed in the bore below the grooved profile, and a lockdown bushing having a tubular body, a locking ring, and an energizing ring that retrievably lands in the bore. The lockdown bushing is adapted to increase lockdown capacity of the wellhead. The lockdown bushing includes a tubular body having an axis and a central bore, the tubular body having a lower end adapted to land on a hanger and an upward facing shoulder on an outer diameter portion of the tubular body. The lockdown bushing also includes a locking ring positioned on the upward facing shoulder and circumscribing the tubular body. The locking ring has an annular locking ring cam surface on an inner diameter of the locking ring. An energizing ring circumscribes the tubular body and is adapted to engage the locking ring with an inner diameter surface of a wellhead. The energizing ring includes a lower portion interposed between the tubular body and the locking ring in an unset position. The lower portion has an outer diameter cam surface adapted to engage the annular locking ring cam surface so that when the energizing ring moves axially downward, the outer diameter cam surface of the energizing ring engages the annular locking ring cam surface to move the locking ring into engagement with the inner diameter of the wellhead to a set position increasing lockdown capacity.

In accordance with another embodiment of the present invention, a lockdown bushing adapted to increase lockdown capacity on a single trip is disclosed. The lockdown bushing includes a tubular body having an axis and a central bore. The tubular body has a lower end adapted to land on a hanger and an upward facing shoulder on an outer diameter portion of the tubular body. A locking ring is positioned on the upward facing shoulder and circumscribes the tubular body. The locking ring has an annular locking ring cam surface on an inner diameter of the locking ring. An energizing ring circumscribes the tubular body and is adapted to engage the locking ring with an inner diameter surface of a wellhead. The energizing ring includes a lower portion interposed between the tubular body and the locking ring in an unset position. The lower portion has an outer diameter cam surface adapted to engage the annular locking ring cam surface so that when the energizing ring moves axially downward, the outer diameter cam surface of the energizing ring engages the annular locking ring cam surface to move the locking ring into engagement with the inner diameter of the wellhead to a set position increasing lockdown capacity.

In accordance with yet another embodiment of the present invention, a method to run and set a lockdown bushing in a wellhead is disclosed. The method provides a lockdown bushing having a locking ring disposed on an upward facing shoulder of the lockdown bushing and an energizing ring secured to an upper portion of the lockdown bushing so that a cam portion of the energizing ring interposed between the locking ring and the lockdown bushing overlaps the locking ring. The method runs the lockdown bushing to a casing hanger landed and set in a bore of the wellhead. The method actuates the running tool to move the energizing ring axially downward to engage an energizing ring cam surface on the cam portion of the energizing ring with a locking ring cam surface on an inner diameter of the locking ring. The method moves the locking ring radially outward into engagement with an inner diameter of the wellhead in response to the downward axial movement of the energizing ring, thereby setting the lockdown bushing.

An advantage of an embodiment is that it provides a lockdown bushing that increases total lockdown capacity. In addition, the disclosed embodiments provide a lockdown bushing that reduces installation time. In some embodiments, the time needed to run, land, and set the lockdown bushing is reduced by over 50% due to ability to be run, land, and set the lockdown bushing in a single trip. In still another advantage, the disclosed embodiments provide a lockdown bushing that may be run and set with standard running and retrieval tools, thereby reducing drilling and installation costs. This may be accomplished by reducing the number of specialty tools needed for installation. In addition, the disclosed lockdown bushing may be run without first running a lead impression tool to determine the location of lockdown grooves or wickers in the wellhead. In yet another advantage, the disclosed embodiments provide a lockdown bushing that accommodates tubing and casing hangers that sit or land high due to debris within the wellhead.

BRIEF DESCRIPTION OF THE DRAWINGS

So that the manner in which the features, advantages and objects of the invention, as well as others which will become apparent, are attained, and can be understood in more detail, more particular description of the invention briefly summarized above may be had by reference to the embodiments thereof which are illustrated in the appended drawings that form a part of this specification. It is to be noted, however, that the drawings illustrate only a preferred embodiment of the invention and are therefore not to be considered limiting of its scope as the invention may admit to other equally effective embodiments.

DETAILED DESCRIPTION OF THE PREFERRED EMBODIMENT

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout.

In the following discussion, numerous specific details are set forth to provide a thorough understanding of the present invention. However, it will be obvious to those skilled in the art that the present invention may be practiced without such specific details. Additionally, for the most part, details concerning rig operation, subsea assembly connections, riser use, and the like have been omitted inasmuch as such details are not considered necessary to obtain a complete understanding of the present invention, and are considered to be within the skills of persons skilled in the relevant art.

Figure 1:
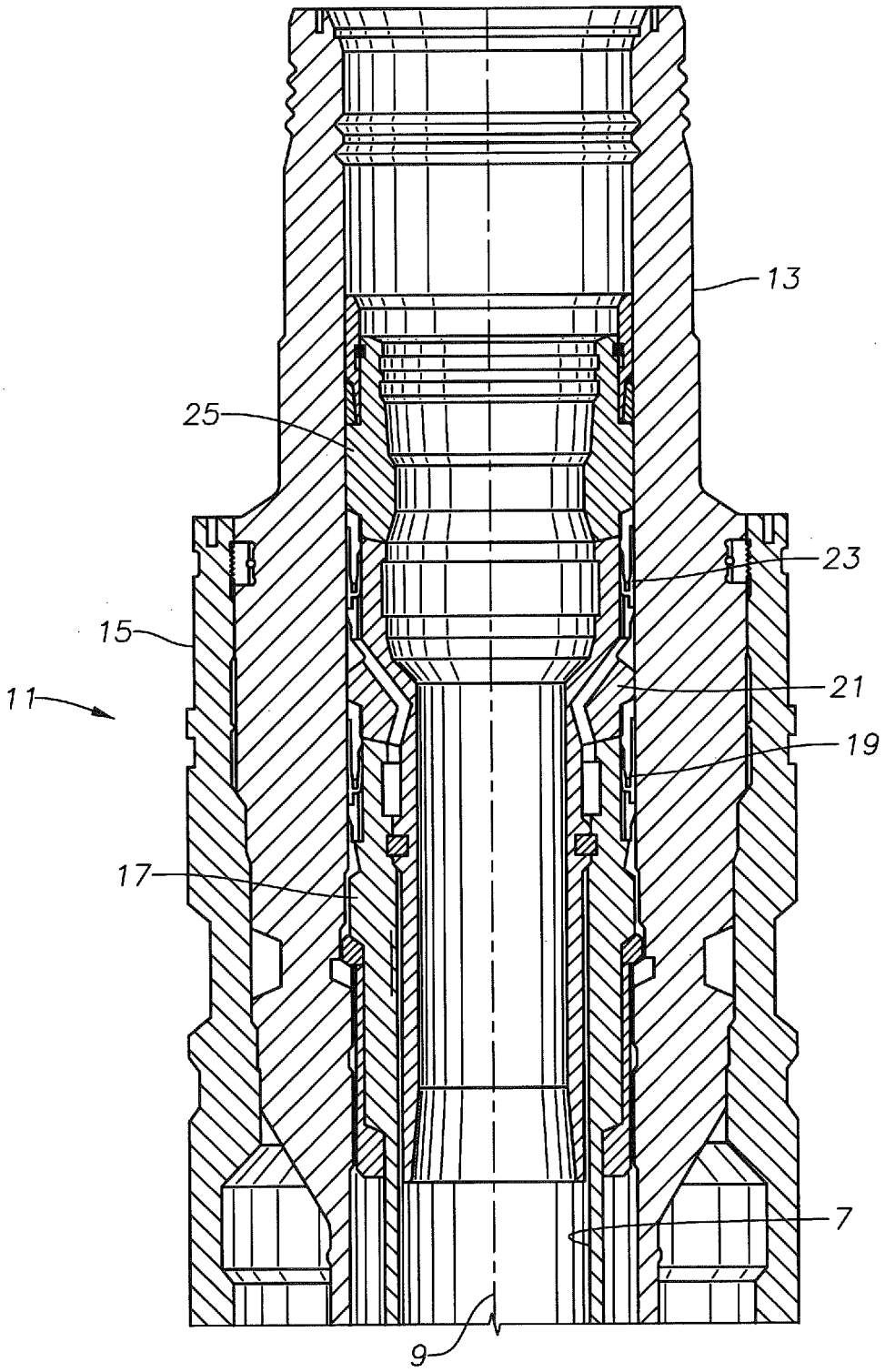
FIG. 1 is sectional view of a wellhead having casing hangers and a lockdown bushing disposed therein in accordance with an embodiment of the present invention.

As shown in FIG. 1, a wellhead 11 includes a high pressure housing 13 and a low pressure housing 15. High pressure housing 13 and low pressure housing 15 are concentric with an axis 9 passing through a central bore or passage 7 of wellhead 11. In an embodiment, wellhead 11 is disposed in a wellbore (not shown) located on a subsea floor (not shown). A portion of the low pressure housing 15 extends into the wellbore. High pressure housing 13 is disposed in low pressure housing 15 and set to form wellhead 11. In the illustrated embodiment, a first casing hanger 17 is landed and set within high pressure housing 13, with a first packoff or seal assembly 19 between first casing hanger 17 and high pressure housing 13. As shown, a second casing hanger 21 is landed and set with a second packoff or seal assembly 23. Second chasing hanger 21 lands in first casing hanger 17. A person skilled in the art will understand that low pressure housing 15, high pressure housing 13, first casing hanger 17 and first seal assembly 19, and second casing hanger 21 and second seal assembly 23 may be run, landed, and set in any suitable manner as is known in the art.

Figure 2:
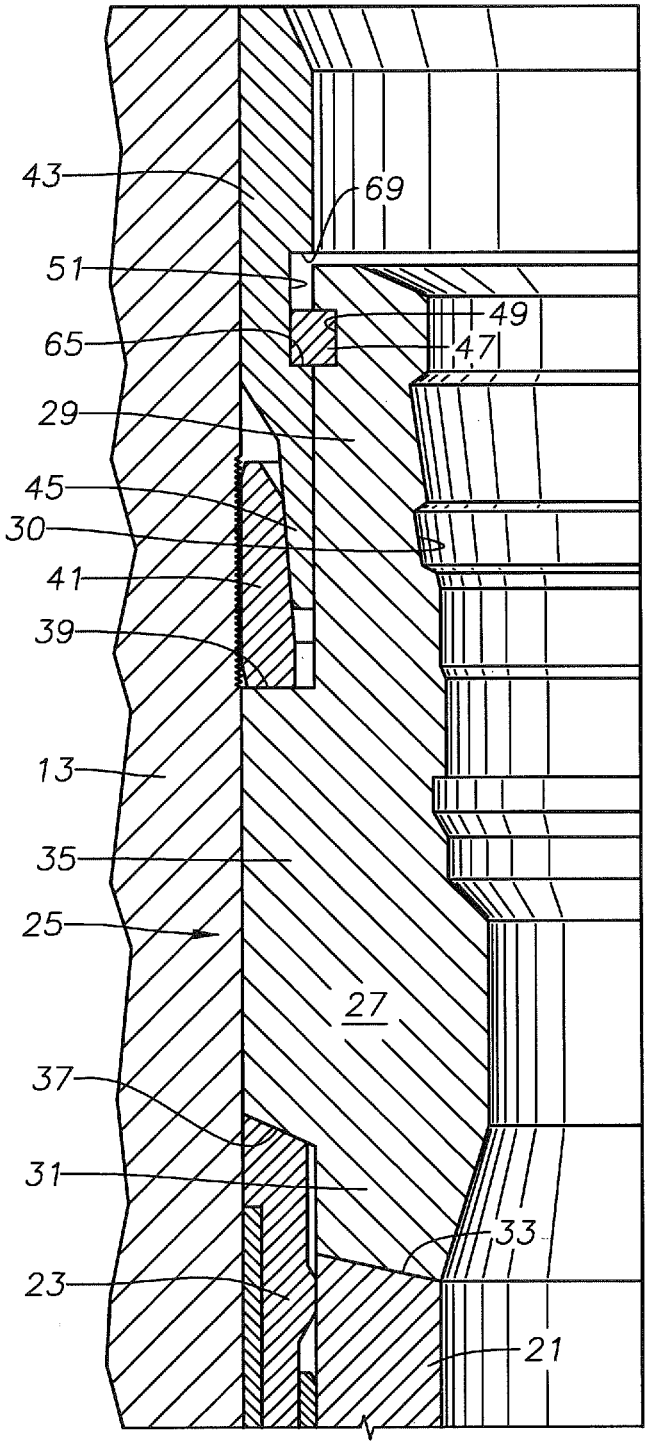
FIG. 2 is a partial sectional view of the lockdown bushing landed in the casing hanger in an unset position in accordance with an embodiment of the present invention.

In the illustrated embodiment, a lockdown bushing 25 may be run and landed on second casing hanger 21. A person skilled in the art will recognize that other embodiments include lockdown bushing 25 landed on first casing hanger 17. Lockdown bushing 25 includes a tubular body 27 having an upper portion 29 and a lower portion 31 as shown in FIG. 2. In an embodiment, tubular body 27 includes a stack up or overall height from a lower end of lower portion 31 to an upper end of upper portion 29 that is substantially equivalent to second casing hanger 21, creating a modular package that can be installed on top of first casing hanger 17 and second casing hanger 21. Lower portion 31 is adapted to land on an upward facing rim 33 of second casing hanger 21. Upper portion 29 has an internal profile 30 adapted to be carried by a standard running tool. For example, a Drill Pipe Running Tool (DPRT); or a MS 700 Pressure Assist Drill Pipe Running Tool (PADRT) both available from Vetco Gray, Inc., a subsidiary of GE Oil and Gas, Inc. may be used to run lockdown bushing 25. In addition, running tools may be used that are similar to those disclosed in the following: U.S. Pat. No. 7,909,107, to Gette, issued Mar. 3, 2011; U.S. patent application Ser. No. 12/490,874, by Eppinghaus, et al., filed Jun. 24, 2009; U.S. patent application Ser. No. 12/856,462, by Eppinghaus, et al., filed Aug. 13, 2010; and U.S. patent application Ser. No. 13/053,911, by Gette, filed Mar. 22, 2011, all of which are incorporated herein by reference. A person skilled in the art will understand that the disclosed running tools are exemplary and not intended to limit the scope of the disclosed embodiments herein. Other running tools not explicitly disclosed herein may be used to run, land, and set lockdown bushing 25. Internal profile 30 will include one or more groove, notches, slots, or other indentations as needed formed in an inner surface of upper portion 29 so that the selected running tool may releaseably secure to lockdown bushing for running and setting of lockdown bushing 25. In an embodiment, internal profile 30 matches an internal profile of second casing hanger 21.

Referring now to FIG. 2, tubular body 27 has a medial portion 35 having an outer diameter that is substantially equivalent to an inner diameter of high pressure housing 13. Medial portion 35 of tubular body 27 extends between lower portion 31 and upper portion 29. On the outer circumference of lockdown bushing 25, the medial portion 35 forms a downward facing shoulder 37 proximate to where medial portion 35 joins lower portion 31. Lockdown bushing 25 also includes an upward facing shoulder 39 opposite downward facing shoulder 37 and proximate to where medial portion 35 joins upper portion 29. An upper portion of second seal assembly 23 is adapted to fit within an annular groove bounded by an outer diameter of lower portion 31 and downward facing shoulder 37 of medial portion 35. As shown, downward facing shoulder 37 may have a horizontal profile to accommodate the upper end of second seal assembly 23. For example, in the illustrated embodiment, downward facing shoulder 37 includes a substantially horizontal portion extending from lower portion 31, a cylindrical portion extending toward medial portion from the horizontal portion opposite lower portion 31 and a conical portion extending from the cylindrical portion to the outer diameter of medial portion 27. As shown, these three portions match the shape of the upper portion of second seal assembly 23. A person skilled in the art will understand that in other embodiments, downward facing shoulder 37 may have a differently shaped profile. In the illustrated embodiments, the outer diameter of lower portion 31 is less than the outer diameter of medial portion 35 to accommodate second seal assembly 23.

An annular locking ring 41 is positioned on upward facing shoulder 39 of medial portion 35 and between upper portion 29 and high pressure housing 13. An energizing ring 43 circumscribes at least a portion of upper portion 29 and has a cam portion 45 interposed between locking ring 41 and upper portion 29. A portion of an axial limiting ring 47 resides within a groove 49 circumscribing an outer surface of upper portion 29. Groove 49 extends radially inward from an outer diameter surface of upper portion 29 and may have a depth less than the total thickness of axial limiting ring 47. A remaining portion of axial limiting ring 47 resides within a limiter groove 51 formed in an inner surface of energizing ring 43. Limiter groove 51 extends radially outward from the inner surface of energizing ring 43, and may have a depth less than the total thickness of axial limiting ring 47 so that portions of axial limiting ring 47 that do not reside within groove 49 may reside within limiter groove 51. In the illustrated embodiment, axial limiting ring 47 has a height substantially equivalent to a height of groove 49 so that axial limiting ring 47 has limited movement axially relative to tubular body 25 when axial limiting ring 47 resides within groove 49. Limiter groove 51 may have a height larger than the height of axial limiting ring 47 so that energizing ring 43 may move axially relative to tubular body 25 as described in more detail below. As energizing ring 43 axially moves relative to tubular body 25, limiter groove 51 will also move axially so that axial limiting ring 47 will land on opposite shoulders 65, 69 of limiter groove 51.

Figure 3:
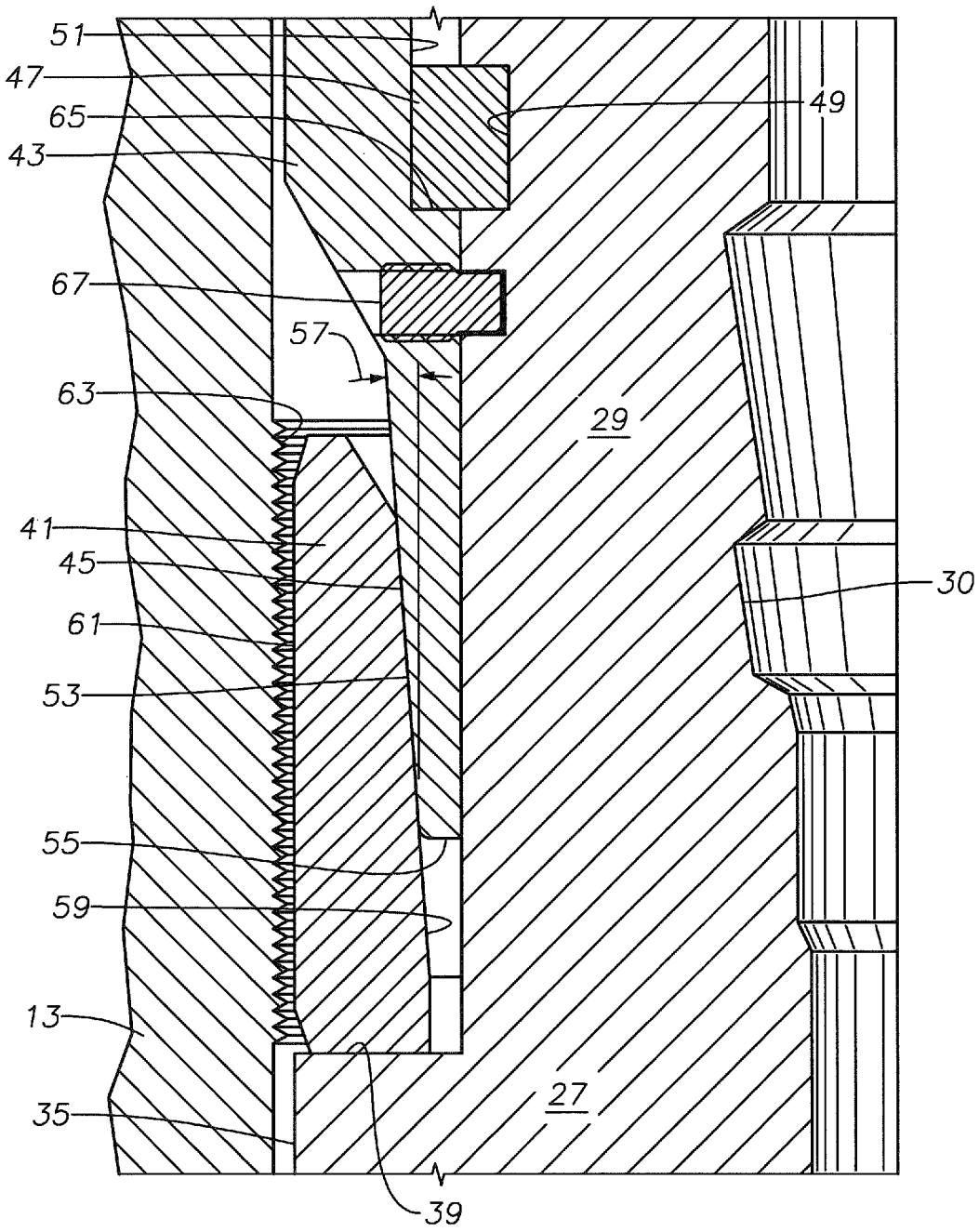
FIG. 3 is a sectional view of a portion of the lockdown bushing in the unset position in accordance with an embodiment of the present invention.

As shown in FIG. 3, cam portion 45 of energizing ring 43 has an outer diameter cam surface 53. Outer diameter cam surface 53 tapers radially outward while extending upward from a lower end 55 of cam portion 53. An angle 57 of cam surface 53 may be selected from a range of about 3 to 7 degrees and in the illustrated embodiments is approximately 4 degrees. Locking ring 41 includes an inner diameter surface 59 having a matching taper to the taper of outer diameter cam surface 53. Cam surface 53 and inner diameter surface 59 may be considered mating surfaces or mating tapered surfaces. Locking ring 41 also has an outer diameter surface 61 that is substantially parallel to axis 9 (FIG. 1). When lockdown bushing 25 is landed on second casing hanger 21 (FIG. 2), outer diameter surface 61 may be proximate to at least a portion of a plurality of wickers 63 formed on an inner diameter surface of high pressure housing 13. A person skilled in the art will recognize that wickers 63 have a profile as disclosed in co-pending U.S. patent application Ser. No. 13/237,687, by Phadke, et al., filed Sep. 20, 2011, the application of which is incorporated herein by reference. A person skilled in the art will understand that the disclosed wickers are exemplary and not intended to limit the scope of the disclosed embodiments. Other wickers 63 having varying profiles are contemplated and included in the disclosed embodiments.

In the landed but unset position illustrated in FIG. 2 and FIG. 3, lower end 55 of cam portion 45 is spaced-apart from upward facing shoulder 39 of medial portion 35 of tubular body 27. Axial limiter ring 47 may be in contact with upward facing shoulder 65 of limiter groove 51. Optionally, one or more cylindrical shear members 67 may extend through radially oriented bores in energizing ring 43 and into corresponding bores of upper portion 29. Shear member 67 may have a length sufficient to extend through energizing ring 43 and seat within upper portion 29 of lockdown bushing 25. Shear members 67 may have a diameter or thickness selected to provide appropriate resistance to shear to prevent premature setting of lockdown bushing 25 during running of lockdown bushing 25. Shear members 67 may maintain energizing ring 43 in the unset position prior to exertion of a predetermined axial force on energizing ring 43.

Figure 4A:
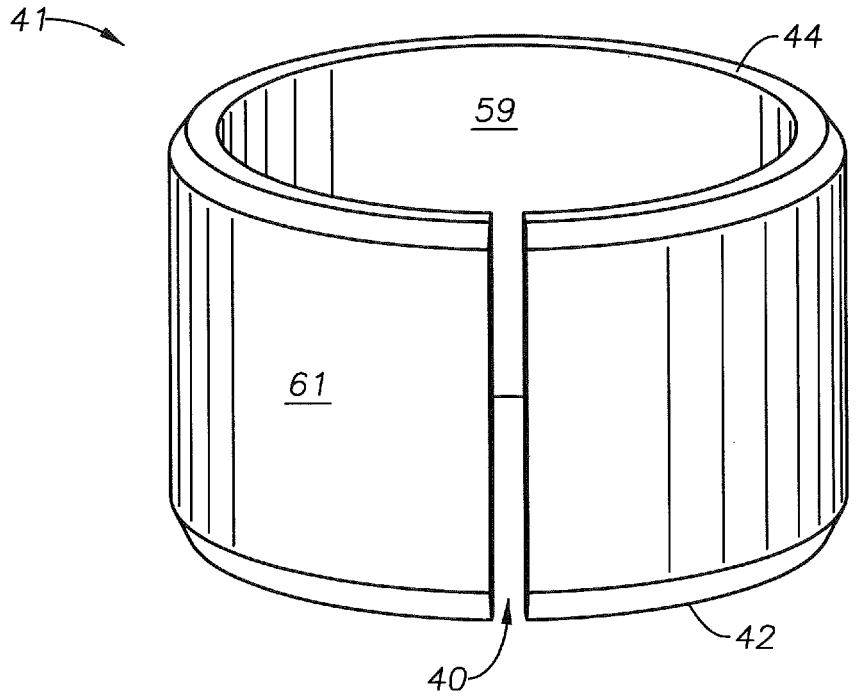
FIGS. 4A-4D are embodiments of a locking ring carried by the lockdown bushing of FIG. 3 in accordance with an embodiment of the present invention.
Figure 4B:
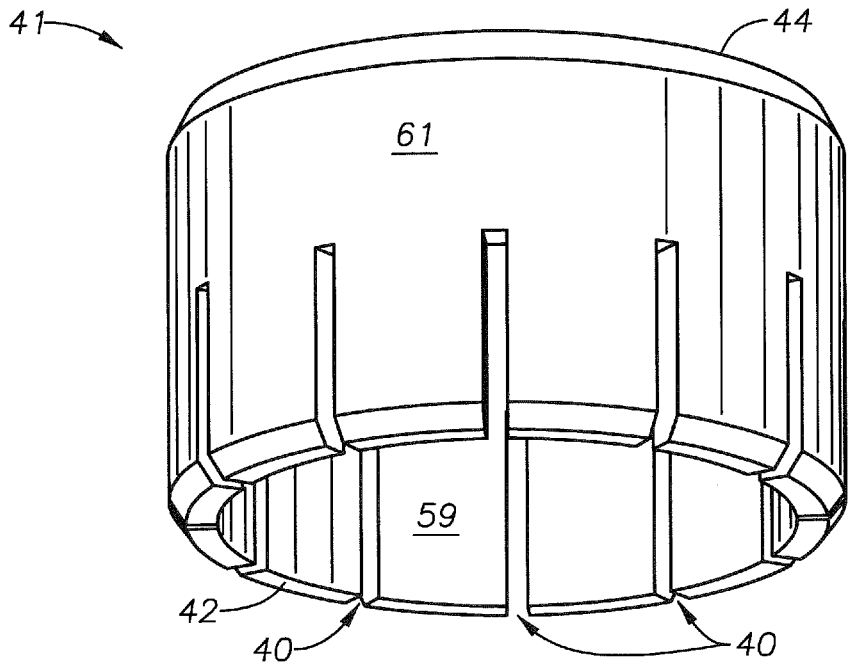
Figure 4C:
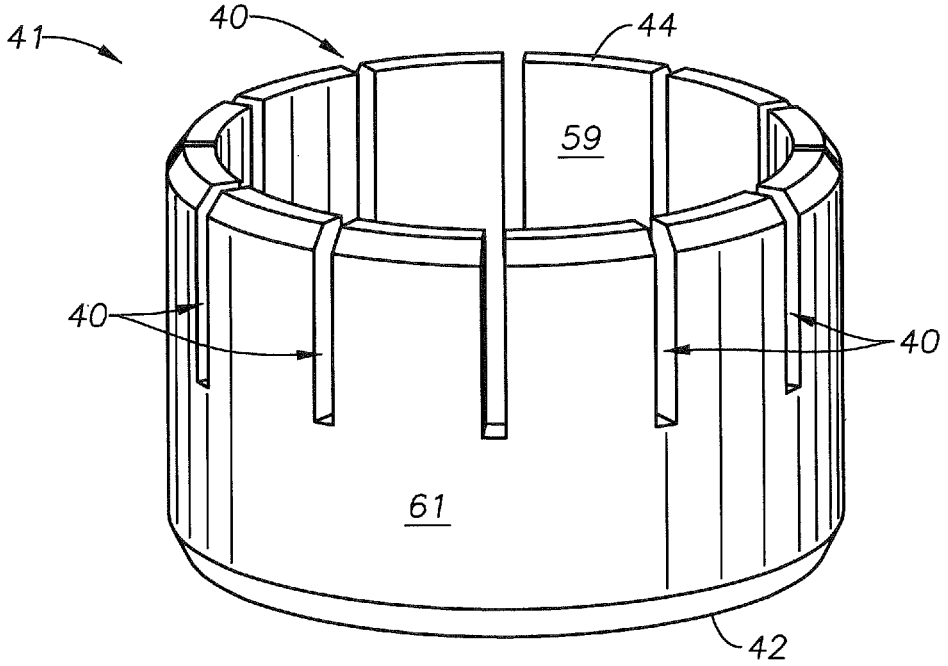
Figure 4D:
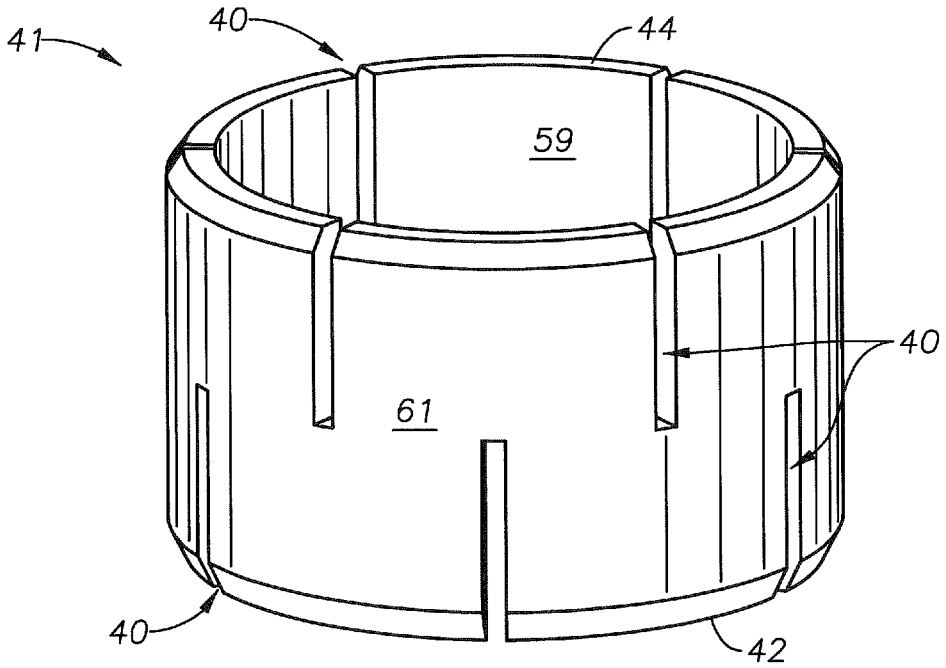

In some embodiments, illustrated in FIGS. 4A-4D, locking ring 41 includes axial saw cuts 40 adapted to reduce installation and retrieval loads without adversely affecting axial load carrying capacity. In an embodiment, locking ring 41 has a single saw cut 40 (FIG. 4B) circumferentially spaced apart that extend through the side wall of the locking ring 41 and a portion of its length. Saw cuts 40 also extending through locking ring 41 so that locking ring 41 may be a split ring as shown in FIG. 4A. In another embodiment, locking ring 41 has multiple saw cuts extending from a lower rim 42 or an upper rim 44 of locking ring 41, as shown in FIGS. 4B and 4C, respectively. In these embodiments, saw cuts 40 do not extend all the way through locking ring 41. In still another embodiment, locking ring 41 has saw cuts 40 extending from both lower rim 42 and upper rim 44 so that non-saw cut portions of locking ring 41 has a serpentine like profile as shown in FIG. 4D. In these embodiments, saw cuts 40 do not extend all the way through locking ring 41. In each of these embodiments, saw cuts 40 decrease hoop stresses in locking ring 41 so that the force required to set and retrieve locking ring 41 is decreased over a locking ring 41 without saw cuts 40. A person skilled in the art will understand that the disclosed embodiments also contemplate and include lock rings 41 with no saw cuts 40.

Figure 5:
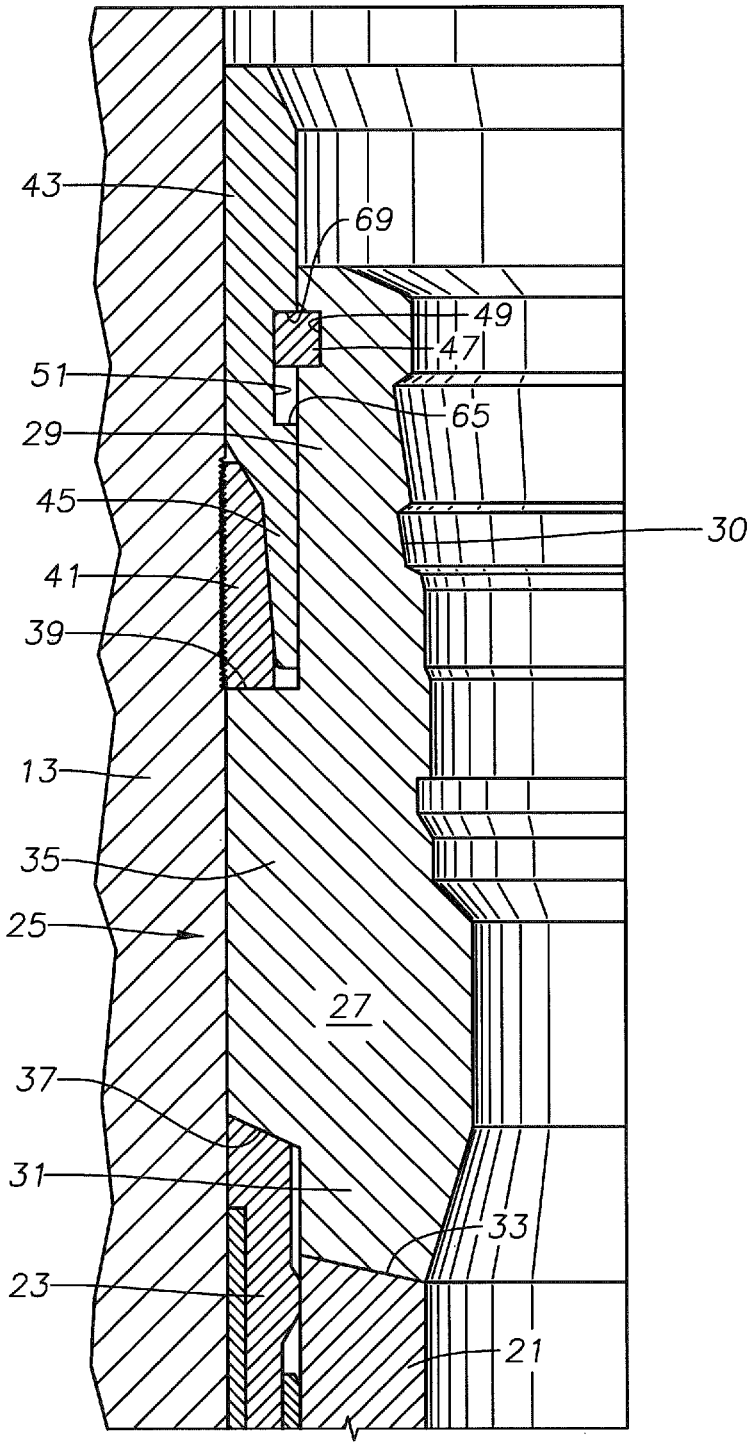
FIG. 5 is a partial sectional view of the lockdown bushing landed in the casing hanger in a set position in accordance with an embodiment of the present invention.
Figure 6:
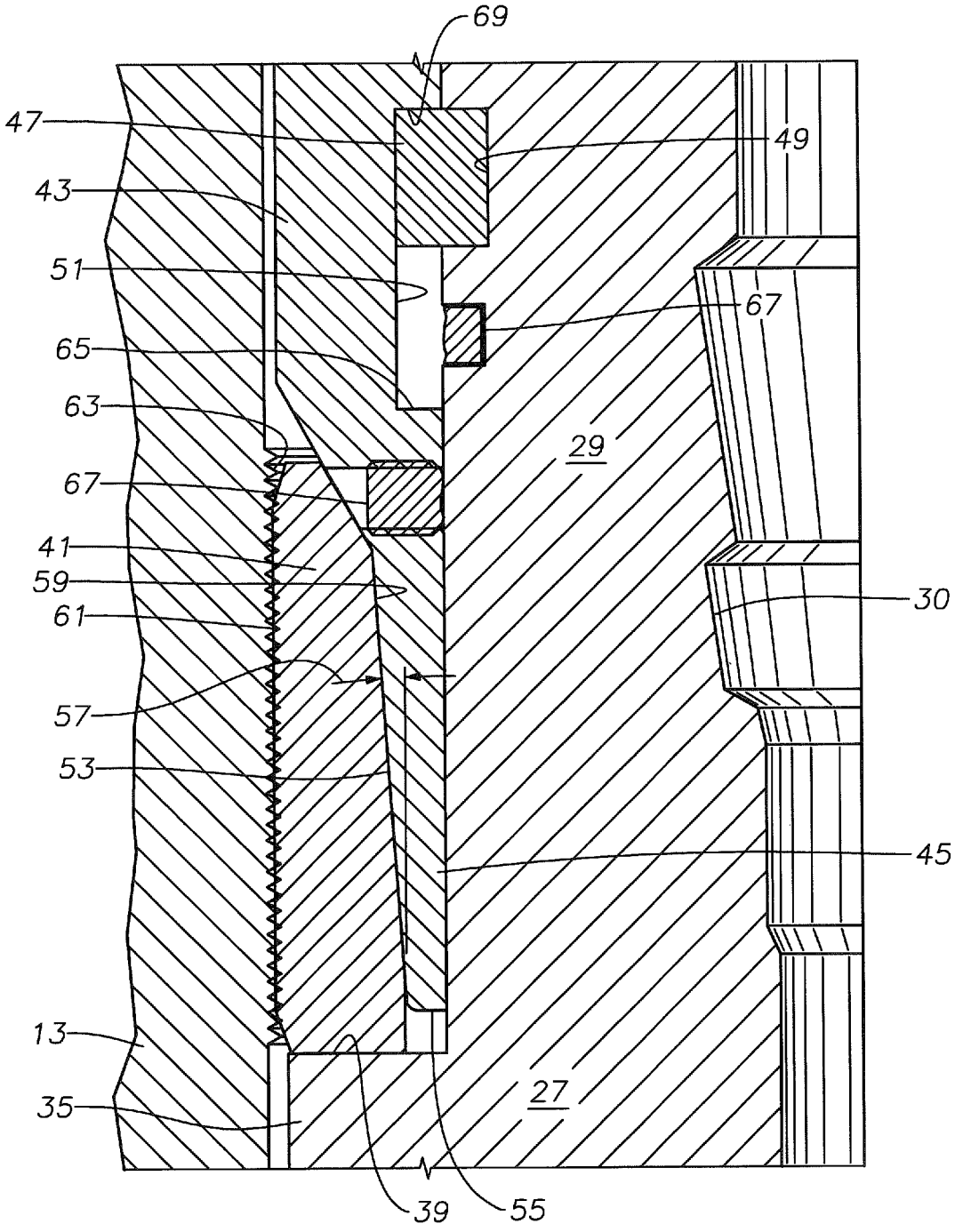
FIG. 6 is a sectional view of a portion of the lockdown bushing in the set position in accordance with an embodiment of the present invention.

As illustrated in FIGS. 5 and 6, energizing ring 43 may be driven axially downward by a running tool, such as a standard running tool having a hydraulically actuated piston adapted to set second seal assembly 23 with fluid pressure supplied through a drill string or riser as disclosed above. As energizing ring 43 is driven axially downward, cam surface 53 of cam portion 45 will slide against cam surface 59 of locking ring 41. The combined width of locking ring 41 and cam portion 45 of energizing ring 43 is greater than the width of upward facing shoulder 39, thus as energizing ring 43 is driven axially downward, the interacting cam surfaces 53, 59 will drive locking ring 41 radially outward. Outer diameter surface 61 of locking ring 41 will move into abutting contact with wickers 63 of the high pressure housing 13. Thereby deforming outer diameter surface 61 with depressions caused by tips of wickers 63. The tips of wickers 63 engage with the depressions to axially couple the locking ring 41 and the high pressure housing 13 thereby setting lockdown bushing 25. Locking ring 41 has a height 46 that permits engagement of up to twice the total wickers 63 when compared to the number of wickers engaged by first seal assembly 19 and second seal assembly 23. In this manner locking ring 41 creates a higher capacity engagement and adding lockdown capacity for lockdown bushing 25.

Figure 7:
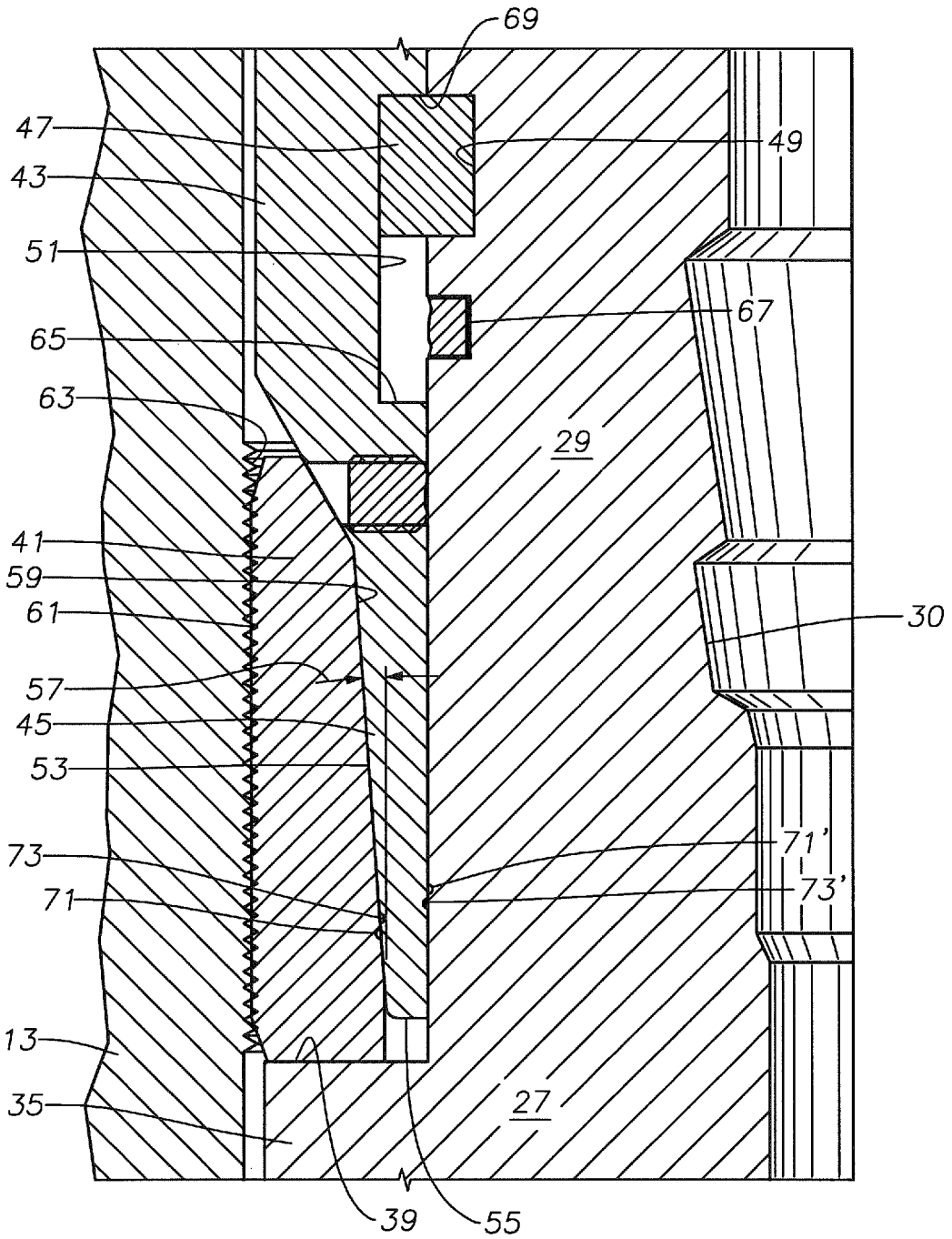
FIG. 7 is a sectional view of the portion of the lockdown bushing of FIG. 5 having detents formed thereon.

Energizing ring 43 may move axially downward until axially limiting ring 47 lands on a downward facing shoulder 69 of limiter groove 51, stopping further downward axial movement of energizing ring 41. In the illustrated embodiment, lower end 55 of cam portion 45 is set back from upward facing shoulder 39 when downward axial movement of energizing ring 43 halts. Cam portion 45 of energizing ring 43 has significant overlap with locking ring 41 in the unset position of FIG. 3. Cam portion 45 extends between locking ring 41 and upper portion 29 along approximately two-thirds of the height of locking ring 41 in the unset position. A person skilled in the art will understand that cam portion 45 may overlap the height of locking ring 41 as little as approximately one-half or fifty percent of the height to greater than two-thirds the height of locking ring 41 in the running or unset position. This overlap permits full engagement of locking ring 41 with wickers 63 with less axial movement by energizing ring 43. This is possible due to angle 57 and the overlap between locking ring 41 and energizing ring 43 in the unset position and permits more of locking ring 61 to engage wickers 63 with less applied hydraulic force to the running tool. In addition, greater engagement of wickers 63 by locking ring 61 by shorter downward axial movement by energizing ring 43. In the set position of FIG. 6, the overlap between cam portion 45 and locking ring 43 may be approximately eighty percent or more. A person skilled in the art will understand that there may be more or less overlap between cam portion 45 and locking ring 41. In an embodiment, the locking interface between outer diameter surface 61 of the locking ring 41 and wickers 63 of high pressure housing 13 may resist over 2.5 million lb ft of upward pressure. The shallow angle 57 of the matching tapers of cam portion 45 and locking ring 41 may friction lock energizing ring 43 and locking ring 41 in the set position of FIGS. 5 and 6, preventing unintended release of locking member 41 from wickers 63 of high pressure housing 13. In some embodiments, shown in FIG. 7, cam surfaces 53, 59 include detents 71, 73, respectively. When in the set position of FIG. 7, detents 71, 73 provide additional locking to increase resistance to unintended release of locking member 41 from high pressure housing 13. Alternatively, detents 71, 73 may be formed on energizing ring 43 and upper portion 29 as shown by detents 71', 73' of FIG. 7. In embodiments having optional shear members 67, the running tool exerts sufficient force to shear members 67 before downward axial movement of energizing ring 41 takes place.

A person skilled in the art will understand that lockdown bushing 25 may be retrieved with a standard retrieval tool such as those disclosed above. During retrieval the running tool may be run to the location of lockdown bushing 25. There, the running tool may be actuated to engaged profile 30 of upper portion 29 of tubular body 27. The running tool may be further actuated to pull axially upward on energizing ring 43 to move energizing ring 43 from the set position of FIGS. 5 and 6 to the unset position of FIGS. 2 and 3. The running tool may then be pulled upward which will in turn pull upward on tubular body 27 through the engaged profile 30. The upward pull on tubular body 27 will cause locking ring 41 to disengage from wickers 63, permitting retrieval of lockdown bushing 25 from wellhead 11.

A person skilled in the art will also understand that energizing ring 43 may include a ratcheting sleeve that is torqued into engagement with a thread profile in the bore of the housing.

Accordingly, the disclosed embodiments provide numerous advantages. For example, the disclosed embodiments provide a lockdown bushing that reduces installation time. In some embodiments, the time needed to run, land, and set the lockdown bushing is reduced by over 50% due to ability to be run, land, and set the lockdown bushing in a single trip. In still another advantage, the disclosed embodiments provide a lockdown bushing that may be run and set with standard running and retrieval tools, thereby reducing drilling and installation costs. This may be accomplished by reducing the number of specialty tools needed for installation. In addition, the disclosed lockdown bushing may be run without first running a lead impression tool to determine the location of lockdown grooves or wickers in the wellhead. In yet another advantage, the disclosed embodiments provide a lockdown bushing that accommodates tubing and casing hangers that sit or land high due to debris within the wellhead.

It is understood that the present invention may take many forms and embodiments. Accordingly, several variations may be made in the foregoing without departing from the spirit or scope of the invention. Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

What is claimed is:

1. A wellhead assembly, comprising:

a wellhead having a bore having a plurality of wickers, the wickers being parallel grooves joining each other at crests;

one or more casing hangers landed in the bore below the wickers;

an annular lockdown bushing coaxially inserted into the bore;

a locking ring set in an annulus between the lockdown bushing and the wickers and selectively moveable from a running position spaced radially inward from the wickers to a set position in non sealing contact with the wickers, the locking ring having an outer diameter surface that is free of grooves in the running position and that has deformations formed by embedding of the crests of the wickers into the outer diameter surface when in the set position; and an energizing ring having an annular portion in contact with an inner diameter surface of the locking ring for moving the locking ring from the running position to the set position in response to downward movement of the energizing ring.

2. The wellhead assembly of claim 1, wherein the inner diameter and outer diameter surfaces of the locking ring expand radially outward then moving from the running in position to the set position.

3. The wellhead assembly of claim 1, further comprising a limiter ring coupled to the lockdown bushing and projecting radially outward into a lower portion of a groove in an inner surface of the energizing ring when the locking ring is in the running position and into an upper portion of the groove when the locking ring is in the set position, the energizing ring being downwardly movable relative to the limiter ring while moving the locking ring from the running position to the set position.

4. The wellhead assembly of claim 1, wherein the energizing ring contacts the locking ring to define a mating tapered surface that is offset about four degrees from an axis of the wellhead assembly.

5. The wellhead assembly of claim 1, wherein the energizing ring is moved a distance of up to about one third a height of the locking ring to move the locking ring from the running position to the set position.

6. The wellhead assembly of claim 1, wherein the inner diameter surface of the locking ring has an an annular locking ring cam surface, and the energizing ring has a lower portion having an outer diameter cam surface, the locking ring cam surface and the energizing ring cam surface have mating detents formed on lower ends of each cam surface, the detents adapted to engage when the locking ring cam surface and the energizing ring cam surface fully engage to secure the energizing ring and the locking ring in the set position.

7. The wellhead assembly of claim 1, wherein the locking ring includes a cut extending from an upper rim of the locking ring to a lower rim of the locking ring to form a split ring.

8. The wellhead assembly of claim 1, wherein the locking ring includes one or more cuts extending from at least one of an upper rim and a lower rim of the locking ring, the cuts circumferentially spaced about the locking ring.

9. The wellhead assembly of claim 1, wherein the locking ring includes a plurality of cuts extending from an upper rim and a lower rim of the locking ring, the cuts circumferentially spaced about the locking ring.

10. A subsea wellhead assembly, comprising:

a wellhead having a bore with an axis;

a set of wickers formed in the bore, the wickers comprising parallel grooves joining each other at sharp crests;

a casing hanger landed in the bore;

a lockdown bushing having a tubular body with a lower end that lands on the hanger and an upward facing shoulder on an outer diameter portion of the tubular body;

a locking ring positioned on the upward facing shoulder and circumscribing the lockdown bushing, the locking ring having an inner diameter with an annular locking ring cam surface, and a cylindrical outer diameter surface;

an energizing ring circumscribing the tubular body to engage the locking ring with the wickers in a non sealing engagement, the energizing ring including a lower portion interposed between the tubular body and the locking ring in an unset position, the lower portion having an outer diameter cam surface in sliding contact with the annular locking ring cam surface so that when the energizing ring moves axially downward, the outer diameter cam surface of the energizing ring engages the annular locking ring cam surface to move the locking ring into engagement with the inner diameter of the wellhead to a set position increasing lockdown capacity, wherein in the set position, the crests of the wickers embed and deform the cylindrical outer diameter surface of the locking ring.

11. The wellhead of claim 10, further comprising a limiter ring interposed between the energizing ring and an upper portion of the tubular body, the limiter ring adapted to engage an upward facing shoulder and a downward facing shoulder of a groove formed in an upper portion of the energizing ring to limit axial movement of the energizing ring.

12. The wellhead of claim 10, wherein the interfacing cam surfaces are offset from the axis at about 4 degrees.

13. The wellhead of claim 10, wherein the energizing ring cam surface and the locking ring cam surface form a friction lock to secure the energizing ring and the locking ring in the set position.

14. The wellhead of claim 10, wherein the cam portion of the energizing ring overlaps the locking ring along at least two-thirds a height of the locking ring in the unset position and overlaps up to ninety-five percent of the locking ring in the set position.

15. The wellhead of claim 10, wherein a plurality of shear elements hold the energizing ring in the running position relative to the tubular body during a running operation.

16. The wellhead of claim 10, wherein the locking ring includes one or more cuts extending from at least one of an upper rim and a lower rim of the locking ring, the cuts circumferentially spaced about the locking ring.

17. A method to run and set a lockdown bushing in a wellhead, the wellhead having a bore with a set of wickers comprising parallel grooves joining each other at crests, the method comprising:

a. providing a lockdown bushing having a locking ring disposed on an upward facing shoulder of the lockdown bushing and an energizing ring secured to an upper portion of the lockdown bushing so that a cam portion of the energizing ring extends between the lockdown bushing and the locking ring;

b. running the lockdown bushing to a casing hanger landed and set in the bore of the wellhead;

c. actuating the running tool to move the energizing ring axially downward to engage an energizing ring cam surface on the cam portion of the energizing ring with a locking ring cam surface on an inner diameter of the locking ring; and d. in response to the downward axial movement of the energizing ring, moving the locking ring radially outward into non sealing engagement with of the wickers with the crests of the wickers deforming and embedding into an outer diameter surface of the locking ring, thereby setting the lockdown bushing.

18. The method of claim 17, wherein step (c) further comprises shearing one or more shear elements holding the energizing ring in an upward axial position relative to the lockdown bushing.

19. The method of claim 17, further comprising engaging a pair of matching detents on the energizing ring cam surface and the locking ring cam surface to secure the energizing ring and the locking ring in the set position.

20. The method of claim 17, wherein moving the locking ring radially outward in step (d) comprises moving both the outer diameter surface and the inner diameter surface radially outward.

* * * * *